United States Patent [19]

Bates

[11] Patent Number: 4,703,865

[45] Date of Patent: Nov. 3, 1987

[54] SEALING CAP

[76] Inventor: William T. D. Bates, 10 Low March, Daventry, Northamptonshire, England

[21] Appl. No.: 872,042

[22] Filed: Jun. 6, 1986

[30] Foreign Application Priority Data

Jun. 10, 1985 [GB] United Kingdom ..... 8514616

[51] Int. Cl.[4] ..... B65D 51/16

[52] U.S. Cl. ..... 215/307

[58] Field of Search ..... 215/307, 311, 314, 260

[56] References Cited

U.S. PATENT DOCUMENTS 404,059 5/1889 Staib ..... 215/311

2,598,403 5/1952 Macey ..... 215/311 X

*Primary Examiner*—Donald F. Norton

*Attorney, Agent, or Firm*—Rodman & Rodman

[57] ABSTRACT

A sealing cap for a bottle or other container comprises a tubular body and a plug disposed within the through-bore of the tubular body. The plug is displaceable within the through-bore from an initial position in which it seals the through-bore, to an intermediate position in which it is a loose fit so that the container may be evacuated through the body, and then to a final position in which it seals the through-bore. The cap has particular utility for blood sampling bottles, which are evacuated and then pierced through the cap by a fine tubular needle so as to apply suction to the needle, from within the bottle, and thus draw a sample of blood through the needle and into the bottle.

16 Claims, 4 Drawing Figures

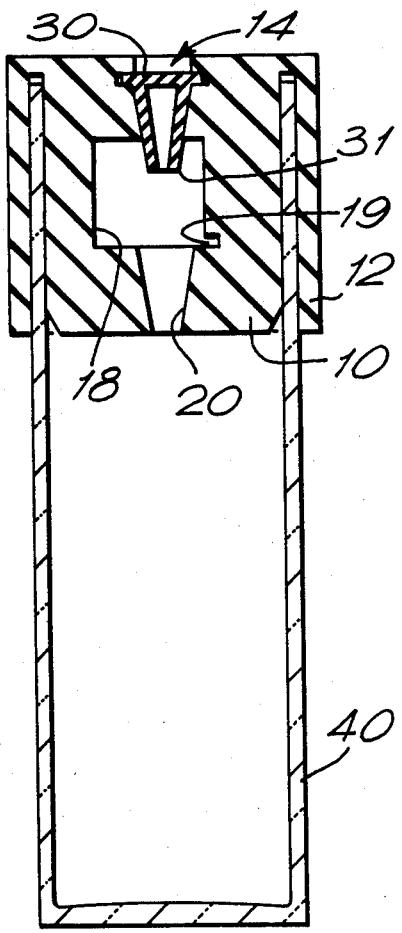
FIG. 1.
FIG. 2.
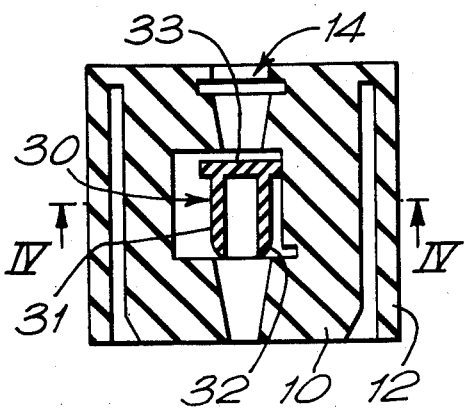
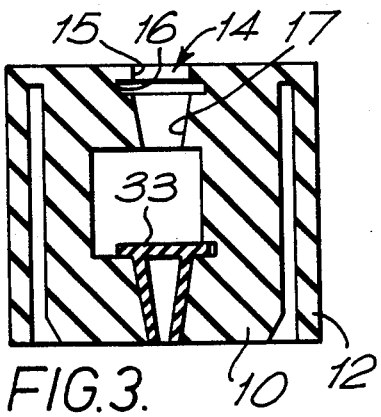
FIG. 3.
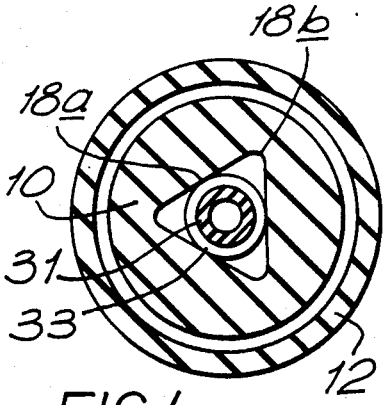
FIG. 4.

SEALING CAP

This invention relates to a cap for sealing a bottle, vessel or container which is required to be evacuated. The cap has utility particularly but not solely in the medical field.

It is known for example in the medical field to provide sealed, pre-evacuated glass bottles or containers. Examples of such containers may be used for collecting a sample of blood, in which case the cap is arranged to be pierced by a fine tube or needle so as to apply suction to that tube, from within the container, and thus draw a sample of blood through the tube and into the container. However, it has not yet been possible to effect a perfect seal nor therefore to maintain the containers under vacuum indefinitely. Thus, when the time comes to use such a container, the user has no guarantee that the container is still evacuated to the required degree.

In accordance with this invention, there is provided a sealing cap for a bottle, vessel or other container, which cap comprises a tubular body, and a plug disposed within the through-bore of said tubular body, the plug being displaceable within said through-bore of the tubular body from a position in which it permits the container to be evacuated through said body, to another position in which it seals said through-bore.

In the preferred embodiment, the cap incorporates a plug which is initially in a first position, sealing the cap. For evacuating the container, the plug is pushed inwards to a second position, in which there is a clearance around the plug to allow air to be withdrawn under suction from the container. Finally, immediately after the evacuation, the plug is pushed inwards to a third position, in which it seals the cap and this seal is assisted by the plug being urged against its sealing seat under the influence of the evacuation in the container.

Preferably the cap body or plug may be pierced, for drawing a sample of blood into the container, by a fine tube or needle through which the blood is drawn by suction provided by the vacuum within the container. The container may be evacuated immediately prior to its intended use, i.e. for receiving a sample of blood.

An embodiment of this invention will now be described by way of example only and with reference to the accompanying drawings, in which:

FIGS. 1, 2 and 3 are vertical sections through a preferred embodiment of sealing cap in accordance with this invention, showing three succesive positions of a plug within a body member of the cap; and FIG. 4 is a section on the line IV—IV shown in FIG. 2.

Referring to the drawings, there is shown a sealing cap for a bottle, vessel or other container. The cap comprises a tubular body portion 10 with an encircling skirt 12 (connected at the top to the body portion) which grips around the outside of the bottle or other container 40 when the body portion is pushed into the open top of the bottle or other container, as shown in FIG. 1. The body portion 10 and skirt 12 are formed in one-piece from rubber or other elastomeric material so that the body portion is slightly resiliently compressed in the radial direction when pushed into the open top of the bottle and the skirt 12 is resiliently expanded in the radial direction: the body portion 10 thus seals against the inner surface of the bottle and the skirt 12 seals around the outersurface of the bottle.

The through-bore 14 which extends axially through the tubular body 10 contains a plug 30, also formed of rubber or other elastomeric material. The plug 30 is displaceable inwardly, relative to the container, from an initial position shown in FIG. 1 in which it seals the through-bore 14, to an intermediate position shown in FIG. 2 in which it permits evacuation of the bottle via the through-bore 14, and further to a final position shown in FIG. 3 in which it seals the bottle (in order to maintain the vacuum created within the bottle whilst the plug was in the position shown in FIG. 2).

The plug 30 comprises a tubular body portion 31 having a bottom section of its outer surface tapered as shown at 32, and a disc portion 33 which closes the top of the body portion and forms an annular ridge around the plug at its top.

The through-bore 14 of the cap body 10 is profiled as follows. At its upper end, the through-bore exhibits a short circular section 15 which is smaller in diameter than at least the disc portion 33 of the plug. Section 15 is followed by a short circular section 16, slightly larger in diameter and axial extent than the disc portion 33 of the plug, and thus forming an annular groove. This is followed by a tapering section 17. In the initial sealing position of the plug as shown in FIG. 1, the plug sits with its disc portion 33 located in the annular groove section 16 and its body portion tightly and sealingly engaged within the tapering section 17.

Below the tapering section 17, the cap body through-bore has a section 18, approximately the length of the plug 30, and having the cross-sectional shape shown in FIG. 4. The section 18 is shaped, relative to the plug 30, such that when the plug is located within the bore section 18 (as shown in FIG. 2), there is clearance between the plug and the surface of the through-bore, so that the bottle or other container may be evacuated through the cap body, yet the plug is confined against tilting movement. Thus, in the example shown, with the plug circular in cross-section, the through-bore at 18 is shaped in cross-section to provide three flat wall sections **18*a* (being the sides of an equilateral triangle) which serve to confine the plug against tilting, which three wall sections are joined by three curved lobes 18*b* which provide the required dlearance for air flow past the plug, when it is located in the position shown in FIGS. 2 and 4. In this position, the annular flange provided by the disc portion 33 of the plug is compressed substantially to the radius of the plug body at its points of contact with the flat wall sections 18*a***.

Below the section 18, the cap body through-bore is formed with a second annular groove section 19 corresponding to section 16, and finally at its lower end with a tapering section 20 similar to section 17. At the lobes **18*b* of section 18, the wall of this section merges with the surface of groove section 19. In the final sealing position of the plug as shown in FIG. 3, the plug sits with its disc portion 33 located in the annular groove section 19 and with its body position tightly and sealingly engaged within the tapering section 20**.

FIG. 1 shows the cap fitted to a glass container 40 which is in the form of a plain cylindrical tube having a flat bottom so that it will stand on a flat surface. In use, the plug is pushed inwardly from this initial position to the position shown in FIG. 2, so that the container can be evacuated through the through-bore 14 of the cap (and around the plug 30). After this evacuation, the plug is pushed inwardly again to the position shown in FIG.

3, in which it seals the through-bore and therefore the container.

The vacuum within the container now serves to draw the plug inwards such that it is urged against the tapering surface 20 and further the cap body is drawn inwards to seal tightly around the rim of the container.

The sealing cap provides for effective and reliable evacuation of the container and then a substantially perfect sealing and containment of the vacuum thus created.

For use as a blood collecting vessel, the cap body on plug can be pierced readily, in the manner explained above. However, the vessel has widespread general use as a standard bottle with leak-proof cap sealed by the internal vacuum, the plug being drawn tightly against its seat and the cap itself drawn tightly against the top of the bottle by the internal vacuum. There is thus provided a substantially perfect, cheap closure cap for all liquids, providing considerable improvements over screw-threaded bottles, which are expensive and provide imperfect sealing. In cases where there is no requirement to pierce the plug, this element may be formed of plastics or other hard material.

I claim:

1. A sealing cap for a bottle, vessel or other container which cap comprises a tubular body having a through-bore, and a plug disposed within said through bore, said plug being displaceable inwardly, relative to said container, from a first position in said through-bore to a second position in said through-bore and being further displaceable inwardly, relative to said container, from said second position to a third position in said through-bore, and wherein said plug seals said through-bore when in said first positon, permits the container to be evacuated through said through-bore when in said second position, and seals said through-bore again when is said third position.

2. A sealing cap as claimed in claim 1, in which said plug has an annular rim which engages in respective annular grooves in said through-bore at each of said first and third positions of the plug.

3. A sealing cap as claimed in claim 2, in which said through-bore has a tapering section in which said plug seats when in said third position in said through-bore.

4. A sealing cap as claimed in claim 3, in which said through-bore has a tapering section in which said plug seats when in said first position in said through-bore.

5. A sealing cap as claimed in claim 4, which said through-bore has a section in which said plug is disposed when in said second position, which section has a cross-sectional shape differing from the cross-sectional shape of the plug, so as to confine the plug against tilting movement whilst providing clearance around the plug at certain locations for air flow during evacuation.

6. A sealing cap as claimed in claim 3, in which said through-bore has a section in which said plug is disposed when in said second position, which section has a cross-sectional shape differing from the cross-sectional shape of the plug, so as to confine the plug against tilting movement whilst providing clearance around the plug at certain locations for air flow during evacuation.

7. A sealing cap as claimed in claim 2, in which said through-bore has a tapering section in which said plug seats when in said first position in said through-bore.

8. A sealing cap as claimed in claim 7, in which said through-bore has a section in which said plug is disposed when in said second position, which section has a cross-sectional shape differing from the cross-sectional shape of the plug, so as to confine the plug against tilting movement whilst providing clearance around the plug at certain locations for air flow during evacuation.

9. A sealing cap as claimed in claim 2, in which said through-bore has a section in which said plug is disposed when in said second position, which section has a cross-sectional shape differing from the cross-sectional shape of the plug, so as to confine the plug against tilting movement whilst providing clearance around the plug at certain locations for air flow during evacuation.

10. A sealing cap as claimed in claim 1, in which said through-bore has a tapering section in which said plug seats when in said third position in said through-bore.

11. A sealing cap as claimed in claim 10, in which said through-bore has tapering section in which said plug seats when in said first position in said through-bore.

12. A sealing cap as claimed in claim 11, in which said through-bore has a section in which said plug is disposed when in said second position, which section has a cross-sectional shape differing from the cross-sectional shape of the plug, so as to confine the plug against tilting movement whilst providing clearance around the plug at certain locations for air flow during evacuation.

13. A sealing cap as claimed in claim 10, in which said through-bore has a section in which said plug is disposed when in said second position, which section has a cross-sectional shape differing from the cross-sectional shape of the plug, so as to confine the plug against tilting movement whilst providing clearance around the plug at certain locations for air flow during evacuation.

14. A sealing cap as claimed in claim 1, which said through-bore has a tapering section in which said plug seats when in said first position in said through-bore.

15. A sealing cap as claimed in claim 14, in which said through-bore has a section in which said plug is disposed when in said second position, which section has a cross-sectional shape differing from the cross-sectional shape of the plug, so as to confine the plug against tilting movement whilst providing clearance around the plug at certain locations for air flow during evacuation.

16. A sealing cap as claimed in claim 1, in which said through-bore has a section in which said plug is disposed when in said second position, which section has a cross-sectional shape differing from the cross-sectional shape of the plug, so as to confine the plug against tilting movement whilst providing clearance around the plug at certain locations for air flow during evacuation.

* * * * *

UNITED STATES PATENT AND TRADEMARK OFFICE

CERTIFICATE OF CORRECTION

PATENT NO. : 4,703,865

DATED : November 3, 1987

INVENTOR(S) : William T. D. Bates

It is certified that error appears in the above-identified patent and that said Letters Patent is hereby corrected as shown below:

At column 3, line 11, change "on" to --or--;

line 36, change "is" to --in--;

line 48, after "4," insert --in--.

At column 4, line 14, change "2" to --3--;

line 25, after "has" insert --a--;

line 41, after "1," insert --in--.

Signed and Sealed this

Twenty-sixth Day of April, 1988

*Attest:*

DONALD J. QUIGG

*Attesting Officer*

*Commissioner of Patents and Trademarks*